US009061526B2

(12) United States Patent
Kono et al.

(10) Patent No.: US 9,061,526 B2
(45) Date of Patent: Jun. 23, 2015

(54) IMAGE FORMING APPARATUS

(71) Applicant: RISO KAGAKU CORPORATION, Minato-ku, Tokyo (JP)

(72) Inventors: Yoshiaki Kono, Tsukuba (JP); Hideaki Ogawa, Tsukuba (JP); Yoshihiro Hanamoto, Tsukuba (JP); Yoshikazu Hara, Tsukuba (JP); Kazuaki Mori, Tsukuba (JP); Hiroaki Takanohashi, Tsukuba (JP); Yousuke Minowa, Tsukuba (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/309,609

(22) Filed: Jun. 19, 2014

(65) Prior Publication Data

US 2015/0002571 A1 Jan. 1, 2015

(30) Foreign Application Priority Data

Jun. 26, 2013 (JP) ..... 2013-134343

(51) Int. Cl.

| | |
|---|---|
| ***B41J 29/38*** | (2006.01) |
| ***B41J 13/00*** | (2006.01) |
| ***B41J 2/01*** | (2006.01) |

(52) U.S. Cl.

CPC ..... *B41J 13/0036* (2013.01); *B41J 2/01* (2013.01)

(58) Field of Classification Search

CPC .... B41J 11/007; B41J 11/0095; B41J 13/103; B41J 13/106; B41J 3/10

USPC ..... 347/16, 101, 104; 271/171, 272

See application file for complete search history.

(56) References Cited

U.S. PATENT DOCUMENTS

| | | | | |
|---|---|---|---|---|
| 5,946,541 | A * | 8/1999 | Kakigi | 399/405 |
| 6,508,168 | B1 * | 1/2003 | Takahashi et al. | 101/120 |
| 7,837,322 | B2 * | 11/2010 | Kusuhata | 347/104 |

FOREIGN PATENT DOCUMENTS

| | | | |
|---|---|---|---|
| JP | 05155511 | A | 6/1993 |
| JP | 07010344 | A | 1/1995 |
| JP | 2004338916 | A | 12/2004 |

* cited by examiner

*Primary Examiner* — An Do

(74) *Attorney, Agent, or Firm* — Holtz, Holtz, Goodman & Chick PC

(57) ABSTRACT

An image forming apparatus having a plurality of paper ejection devices includes a control unit which performs control to allow before a paper ejection device, which is continuously ejecting paper in the plurality of paper ejection devices, ejects paper over the maximum loading a paper ejection device which is not ejecting paper to prepare for starting an operation based on the time taken for the paper ejection device which is not ejecting paper to become operable and the number of ejectable sheets before a loading of the paper ejection device which is continuously ejecting paper reaches the maximum loading.

5 Claims, 12 Drawing Sheets

IMAGE FORMING APPARATUS

CROSS-REFERENCE TO RELATED APPLICATIONS

This application is based upon and claims the benefit of priority of the prior Japanese Patent Application No. 2013-134343, filed on Jun. 26, 2013, the entire contents of which are incorporated herein by reference.

TECHNICAL FIELD

The present invention is related to an image forming apparatus, more specifically to an image forming apparatus having a plurality of paper ejection devices.

BACKGROUND ARTS

A printer is used as an image forming apparatus which forms a specified image on printing paper. Especially, various optional devices may be connected to a business-use printer, and an image forming apparatus is configured by connecting an optional device to a printer. An optional device may be a paper ejection device, and paper printed by a printer is ejected to a paper ejection device.

Patent Documents 1 and 2 disclose the technology of connecting a plurality of paper ejection device to a printer. In the technology according to the Patent Document 1, a remainder detecting sensor is provided in each of a plurality of stackers, and the remainders of the stackers are compared with the number of printed sheets for one printing job, thereby selecting a stacker. In the technology according to the Patent Document 2, a plurality of stackers are provided, and the first stacker to become full (the stacker which has first become full) is displayed as blank, thereby changing the destination stacker for paper ejection.

[Patent Document 1] Japanese Laid-open Patent Publication No. 5-155511

[Patent Document 2] Japanese Laid-open Patent Publication No. 2004-338916

SUMMARY OF THE INVENTION

Some of the above-mentioned paper ejection devices have a power supply. Although the power supply is placed in an ON position while the paper ejection device provided with the power supply is working, the power supply is turned off while the device is not working, thereby reducing energy consumption.

In the technology according to Patent Documents 1 and 2, the destination of paper ejection is switched to another stacker when the current stacker becomes full, but the continuous paper ejection is temporarily stopped when power supply of the other paper ejection device is placed in the OFF position.

To put a paper ejection device which is not ejecting paper in an operable state, the device is to be turned on, and some recovery time is required. Since the continuous paper ejection is suspended for the recovery time, the recovery time is a waiting time, thereby incurring reduced productivity. Especially when an initializing operation is required in recovering the power supply, the waiting time is extended and incurs considerable reduction in productivity.

The present invention aims at switching a destination of paper ejection with high productivity in an image forming apparatus having a plurality of paper ejection devices.

According to an aspect of the present invention, the image forming apparatus having a plurality of paper ejection devices includes a control unit which performs control to allow before a paper ejection device, which is continuously ejecting paper in the plurality of paper ejection devices, ejects paper over the maximum loading a paper ejection device which is not ejecting paper to prepare for starting an operation based on the time taken for the paper ejection device which is not ejecting paper to become operable and the number of ejectable sheets before a loading of the paper ejection device which is continuously ejecting paper reaches the maximum loading.

According to the aspect above, since the control is performed to switch a destination of paper ejection based on the time taken for the paper ejection device which is not ejecting paper to become operable and the number of ejected sheets counted before loading of the paper ejection device which is continuously ejecting paper reaches the maximum loading, the time taken for the paper ejection device which is not ejecting paper to enter the operable state may overlap with the ejecting time of the paper ejection device which is continuously ejecting paper. Therefore, the destination of paper ejection may be quickly switched, thereby improving the productivity.

DESCRIPTION OF THE EMBODIMENTS

Figure 1:
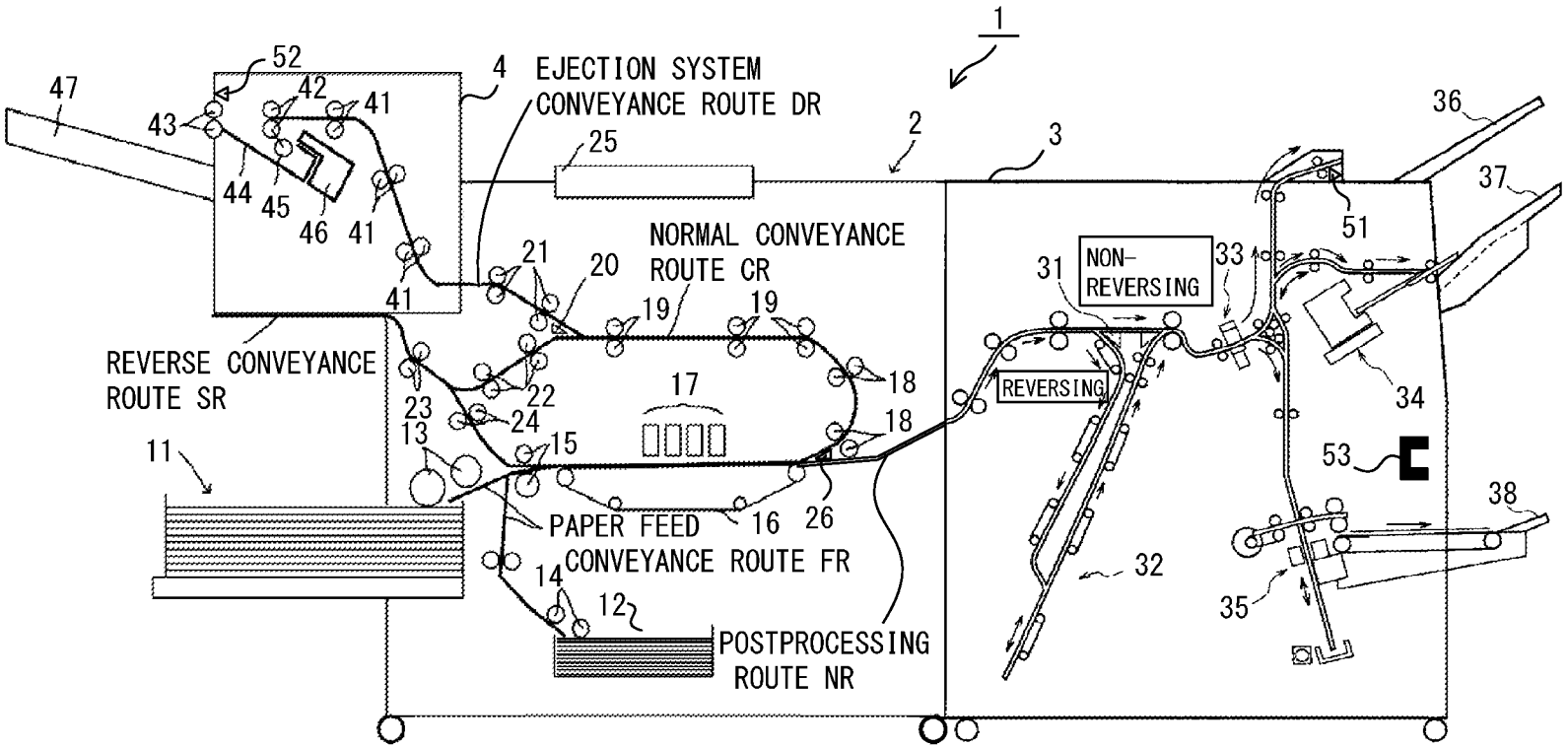
FIG. 1 is an internal configuration of an image forming apparatus according to the first embodiment.

Configuration of the Image Forming Apparatus According to the First Embodiment The first embodiment of the present invention is described below with reference to the attached drawings. FIG. 1 is an internal configuration of an image forming apparatus 1 according to the first embodiment of the present invention.

The image forming apparatus 1 is configured mainly by a printer 2. A first paper ejection device 3 and a second paper ejection device 4 are connected to the printer 2, and the image forming apparatus 1 is configured by these devices.

The printer 2 is a device for printing a specified image, character, illustration, etc. on printing paper. The first paper ejection device 3 is an optional device which performs a specified process against the paper printed by the printer 2 and ejects the paper. The second paper ejection device 4 is also an optional device like the first paper ejection device 3, performs a specified process against the paper printed by the printer 2, and ejects the paper.

The first paper ejection device 3 and the second paper ejection device 4 are connected to the printer 2 as removable therefrom. FIG. 1 is an example of connecting two paper ejection devices to the printer 2, but three or more paper ejection devices may be connected to the printer 2. The first paper ejection device 3 and the second paper ejection device 4 may be provided with, for example, a stapling function, a punching function for a punch hole, etc.

Described next is the printer 2. The printer 2 illustrated in FIG. 1 is an example, and the configuration is not limited to that illustrated in FIG. 1, but any configuration may be adopted.

The printer 2 includes an external paper tray 11, an internal paper tray 12, external paper feed rollers 13, internal paper feed rollers 14, paper stop rollers 15, a conveyance belt 16, a printing unit 17, upward conveyance rollers 18, level conveyance rollers 19, a first switch unit 20, paper ejecting conveyance rollers 21, reversing conveyance rollers 22, reversing rollers 23, paper re-feed rollers 24, and a display unit 25. The printer 2 is also provided with a paper feed conveyance route FR, a normal conveyance route CR, an ejection system conveyance route DR, a reverse conveyance route SR, and a postprocessing route NR.

The external paper tray 11 is loaded with paper for use in printing. In this example, a part of the external paper tray 11 is set as exposed outward from the printer 2. The internal paper tray 12 is similarly loaded with paper for use in printing. In this example, the internal paper tray 12 is set inside the printer 2. The external paper tray 11 and the internal paper tray 12 function as a paper feed device for feeding paper.

The external paper feed rollers 13 pick up each sheet of paper from the external paper tray 11, and convey each sheet to the paper stop rollers 15 along the paper feed conveyance route FR. Similarly, the internal paper feed rollers 14 pick up each sheet of paper from the internal paper tray 12, and convey the sheet toward the paper stop rollers 15 along the paper feed conveyance route FR.

The paper stop rollers 15 temporarily stops the sheet of paper conveyed from the external paper feed rollers 13, the internal paper feed rollers 14, and the paper re-feed rollers 24. Afterwards, a skew adjustment is made, and the sheet is conveyed toward the conveyance belt 16 and the printing unit 17.

The conveyance belt 16 is arranged in the downstream of the paper stop rollers 15, and conveys paper while adsorbing the paper conveyed by the paper stop rollers 15 on the conveyance surface formed on the surface of the conveyance belt 16. The conveyance belt 16 is a circular endless belt applied to a driving roller and a driven roller.

The conveyance belt 16 has a number of belt holes (not illustrated in the attached drawings) as through holes for adsorbing and holding a sheet of paper. The conveyance belt 16 conveys the sheet of paper adsorbed and held on the conveyance surface to the right in FIG. 1 by turning it clockwise in FIG. 1 by the drive of the driving roller.

The printing unit 17 is arranged above the conveyance belt 16, and has a plurality of line type inkjet heads having nozzles arranged in the direction normal to the conveyance direction of paper. The printing unit 17 jets ink from the nozzles of the inkjet heads on a sheet of paper conveyed by the conveyance belt 16, and prints an image.

The upward conveyance rollers 18 convey a sheet of paper received from the conveyance belt 16 and printed by the printing unit 17 upward in FIG. 1 toward the level conveyance rollers 19 while nipping the paper.

The level conveyance rollers 19 convey the paper received from the upward conveyance rollers 18 from right to left in FIG. 1 while nipping the paper. The level conveyance rollers 19 are arranged along the normal conveyance route CR.

The first switch unit 20 is configured so that the paper conveyance route may be switched between the ejection system conveyance route DR and the reverse conveyance route SR.

The first switch unit 20 is arranged at the branch point between the ejection system conveyance route DR and the reverse conveyance route SR.

For example, when two-side printing is performed on printing paper, the first switch unit 20 performs switching so that one side printed paper may be conveyed to the reverse conveyance route SR. Then, the reversing conveyance rollers 22 convey the paper received from the normal conveyance route CR toward the reversing rollers 23.

The reversing rollers 23 temporarily convey the one side printed paper to the reverse conveyance route SR, then take up the paper, and convey the paper to the paper re-feed rollers 24. The reversing rollers 23 are arranged along the reverse conveyance route SR. The reverse conveyance route SR is a space for the temporary hold of the paper. The reverse conveyance route SR is provided below the second paper ejection device 4.

The paper re-feed rollers 24 convey the paper conveyed by the reversing rollers 23 toward to the paper stop rollers 15. The paper re-feed rollers 24 are arranged along the route formed by the reversing rollers 23 and the paper stop rollers 15. The one side printed paper is conveyed from the paper stop rollers 15 to the conveyance belt 16. Then, the one side printed paper is printed by the printing unit 17, and conveyed through the upward conveyance rollers 18 and the level conveyance rollers 19.

Furthermore, if printing paper reaches the first switch unit 20 on the normal conveyance route CR when the paper is ejected in the one-side printing or the two-side printing, the route is switched from the normal conveyance route CR to the ejection system conveyance route DR, and the paper is conveyed from the first switch unit 20 while it is nipped by the paper ejecting conveyance roller 21.

A second switch unit 26 is arranged along the normal conveyance route CR. The paper conveyed in the normal conveyance route CR may also be conveyed to the first paper ejection device 3. To convey the paper to the first paper ejection device 3, the second switch unit 26 switches the direction of the conveyance of the paper.

The display unit 25 is a panel for issuing an instruction from a user of the printer 2, and is provided on the top surface of the printer device.

The outline of the configuration of the printer 2 is described above. Described below is the first paper ejection device 3 connected to the printer 2. The first paper ejection device 3 illustrated in FIG. 1 is an example, and an optional configuration may be adopted.

The first paper ejection device 3 includes a third switch unit 31, a reverse unit 32, a punching unit 33, a stapling unit 34, a saddle stitch unit 35, a top tray 36, a stacking tray 37, and a booklet tray 38.

The third switch unit 31 switches the paper between reversing and non-reversing. When the paper is reversed, the paper is led to the reverse unit 32, the face of the paper is reversed, and the reversed paper is returned to the same route as the non-reversing operation.

The punching unit 33 performs the punching process for making a punch hole in printing paper depending on the printing job. The stapling unit 34 performs the stapling process on printing paper. Long-side binding, or short-side binding may be used as the stapling process. The saddle stitch unit 35 performs the saddle stitching process (folding process).

The paper on which the punching process has been performed, or the unprocessed paper is ejected and stacked on the top tray 36. The paper on which the punching process has been performed, the stapled paper, or the unprocessed paper is ejected and stacked on the stacking tray 37. The paper on which the punching process has been performed, the paper on which the saddle stitching process has been performed, or unprocessed paper is ejected and stacked on the booklet tray 38.

In this example, it is assumed that the top tray 36, the stacking tray 37, and the booklet tray 38 have no power supply, but each tray may be provided with a power supply. When each tray is provided with a power supply, each tray functions as a paper ejection device.

Described next is the second paper ejection device 4. The second paper ejection device 4 is connected to the printer 2, and printing paper is conveyed from the ejection system conveyance route DR to the second paper ejection device 4. The second paper ejection device 4 includes paper ejecting conveyance rollers 41, paper ejection rollers 42, reversing conveyance rollers 43, a support member 44, a conveyance roller(s) 45, a postprocessing unit 46, and a paper ejection table 47.

The paper conveyed from the ejection system conveyance route DR of the printer 2 is received by the paper ejecting conveyance rollers 41 and then conveyed. The paper ejection rollers 42 nip the paper from the paper ejecting conveyance rollers 41. Then, the paper ejection rollers 42 receive the paper from the paper ejecting conveyance rollers 41, and eject printing paper sheet by sheet to the paper ejection table 47.

In addition, when the postprocessing such as the stapling process, the punching process, etc. is performed against printing paper, the printing paper is ejected to the support member 44, and transmitted to the postprocessing unit 46 by the conveyance roller(s) 45. The postprocessing such as the stapling process, the punching process, etc. is performed against the printing paper transmitted to the postprocessing unit 46.

A first sensor 51 is provided for the first paper ejection device 3, and a second sensor 52 is provided for the second paper ejection device 4. The first sensor 51 is a sensor for detecting that the printing paper stacked on the top tray 36 has reached nearly maximum loading. The maximum loading refers to the amount that disables ejection of the paper to the paper ejection device. The nearly maximum loading refers to the amount close to the maximum loading although not reaching the maximum loading.

The second sensor 52 is provided for the second paper ejection device 4, and detects that the printing paper stacked on the paper ejection table 47 has reached nearly maximum loading like the first sensor 51 described above.

A third sensor 53 is provided for the first paper ejection device 3, and detects the height of the lowest position of the stacking tray 37. As the printing paper is ejected to the stacking tray 37, it goes down by the driving device such as a motor etc. at specified intervals. The third sensor 53 is arranged at the position in which the lowest height of the stacking tray 37 may be detected.

<Configuration of the Control Unit>

Figure 2:
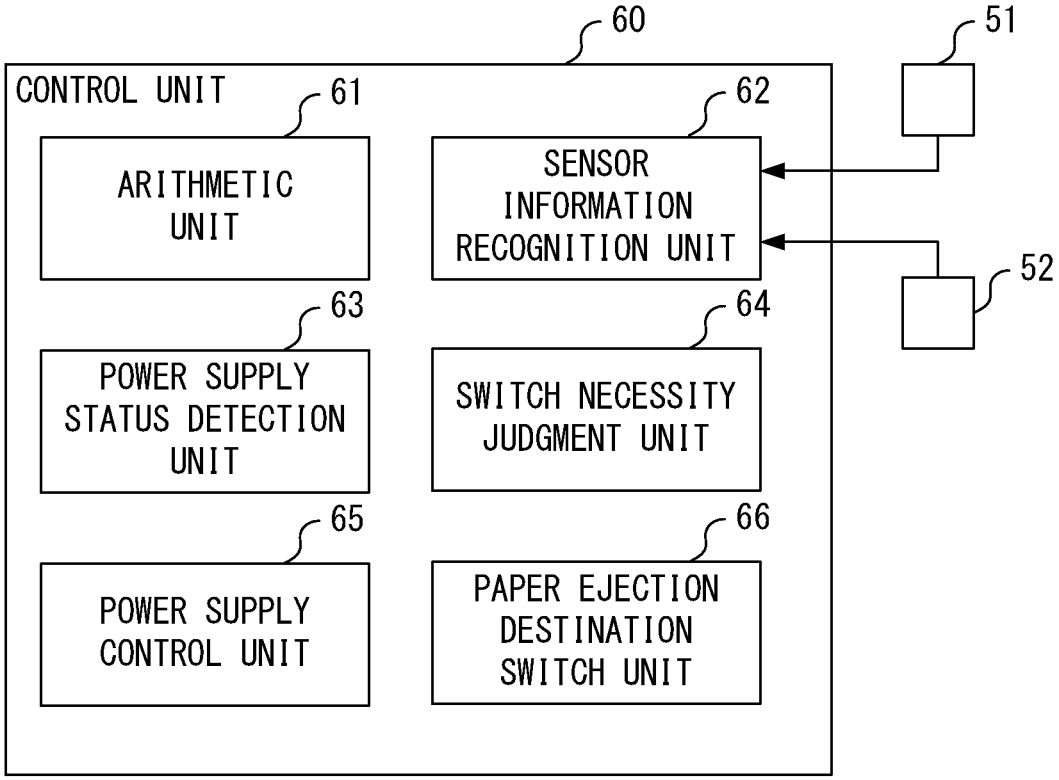
FIG. 2 is a block diagram of the function of the control unit in the first example.

The control unit 60 for controlling the operation according to the present embodiment is described below with reference to FIG. 2. A control unit 60 illustrated in FIG. 2 is implemented in the printer 2, and includes, for example, a CPU (central processing unit), RAM (random access memory), ROM (read only memory), etc. When the CPU executes a specified program expanded in the RAM, the function of the control unit 60 is performed.

As illustrated in FIG. 2, the control unit 60 includes an arithmetic unit 61, a sensor information recognition unit 62, a power supply status detection unit 63, a switch necessity judgment unit 64, a power supply control unit 65, and a paper ejection destination switch unit 66.

The arithmetic unit 61 performs a specified arithmetic. The contents of the arithmetic are described later. The sensor information recognition unit 62 is connected to the first sensor 51 and the second sensor 52. When the first sensor 51 detects the paper surface of the printing paper stacked on the top tray 36, information representing the detection of the paper surface is input to the sensor information recognition unit 62. When the second sensor 52 detects the paper surface of the printing paper stacked on the paper ejection table 47, information representing the detection of the paper surface is input to the sensor information recognition unit 62.

The power supply status detection unit 63 detects whether the power supply of the paper ejection device which is not ejecting paper (the second paper ejection device 4 in this case) is turned ON or OFF. The switch necessity judgment unit 64 judges the necessary of the switch of the destination of paper ejection based on whether or not the number of remaining sheets of paper in the printing job is larger than the number of sheets of paper which may be ejected to the first paper ejection device 3.

The case in which the power supply is turned off refers to not only the case in which the power supply is completely cut off, but also the energy saving state (sleep mode) etc. That is, it is assumed that the power supply is not turned on, but the power supply is turned off when the device is not immediately operable.

The power supply control unit 65 performs the control of turning on the second paper ejection device 4 which is currently placed in the OFF position. The paper ejection destination switch unit 66 performs the control of switching the destination of paper ejection from the first paper ejection device 3 to the second paper ejection device 4.

Operation of the First Embodiment

Described next is the operation according to the first embodiment. As illustrated in FIG. 1, two paper ejection devices (first paper ejection device 3 and second paper ejection device 4) are connected to the printer 2 that performs as the image forming apparatus 1.

The printing job output by a personal computer, an external connection device, etc, which is not illustrated in the attached drawings, is input to the printer 2. The printer 2 performs a printing operation according to the input printing job. In this case, it is assumed that the printing job is continuous printing.

The paper printed by the printer 2 is continuously ejected to any of the first paper ejection device 3 and the second paper ejection device 4. When paper is ejected to the first paper ejection device 3, the paper is ejected on the top tray 36. When paper is ejected to the second paper ejection device 4, the paper is ejected on the paper ejection table 47. In this example, the continuous paper ejection to the first paper ejection device 3 is performed.

In this example, the first paper ejection device 3 and the second paper ejection device 4 are provided with a power supply. When the printing operation is performed by utilizing the first paper ejection device 3, the first paper ejection device 3 is turned on. On the other hand, since no paper is ejected to the second paper ejection device 4, the second paper ejection device 4 is turned off. Thus, the unnecessary power consumption by the second paper ejection device 4 which is not currently operating may be suppressed.

Therefore, the first paper ejection device 3 is turned on, and the second paper ejection device 4 is turned off. When the paper ejection to the second paper ejection device 4 is performed, the second paper ejection device 4 is turned on and the first paper ejection device 3 is turned off.

Figure 3:
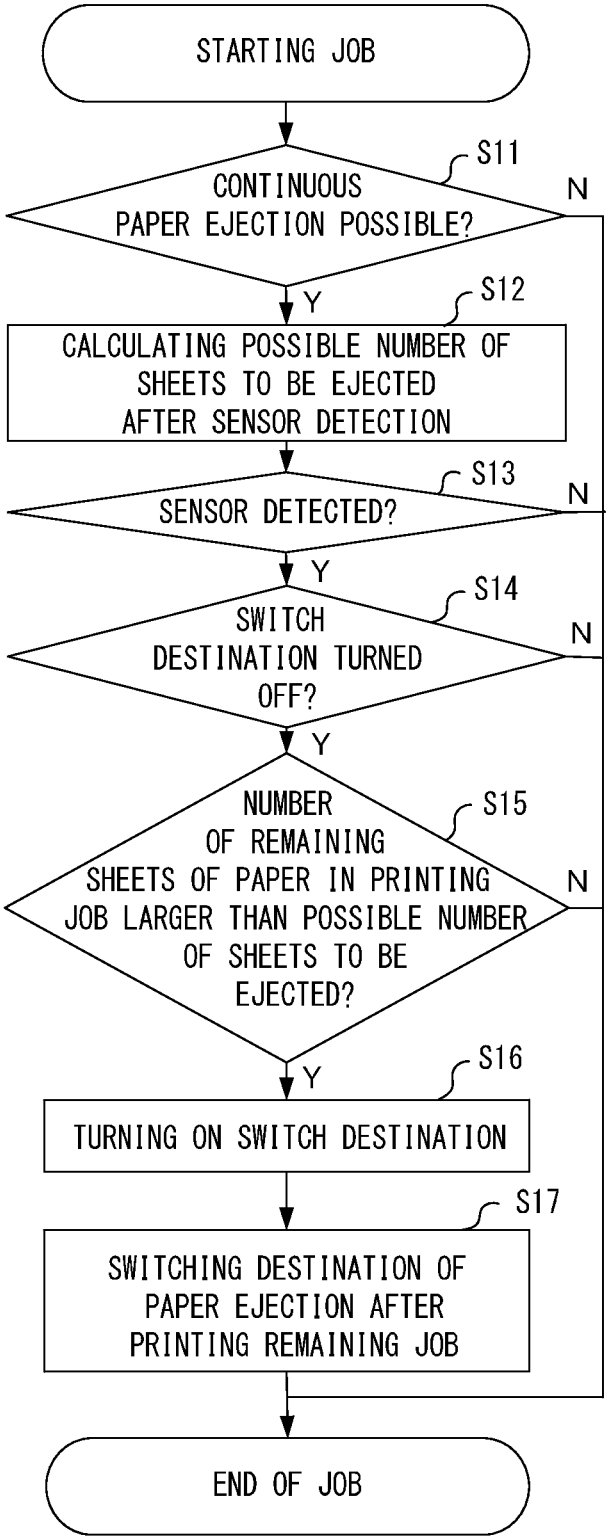
FIG. 3 is a flowchart of the processes in the first example.
Figure 5:
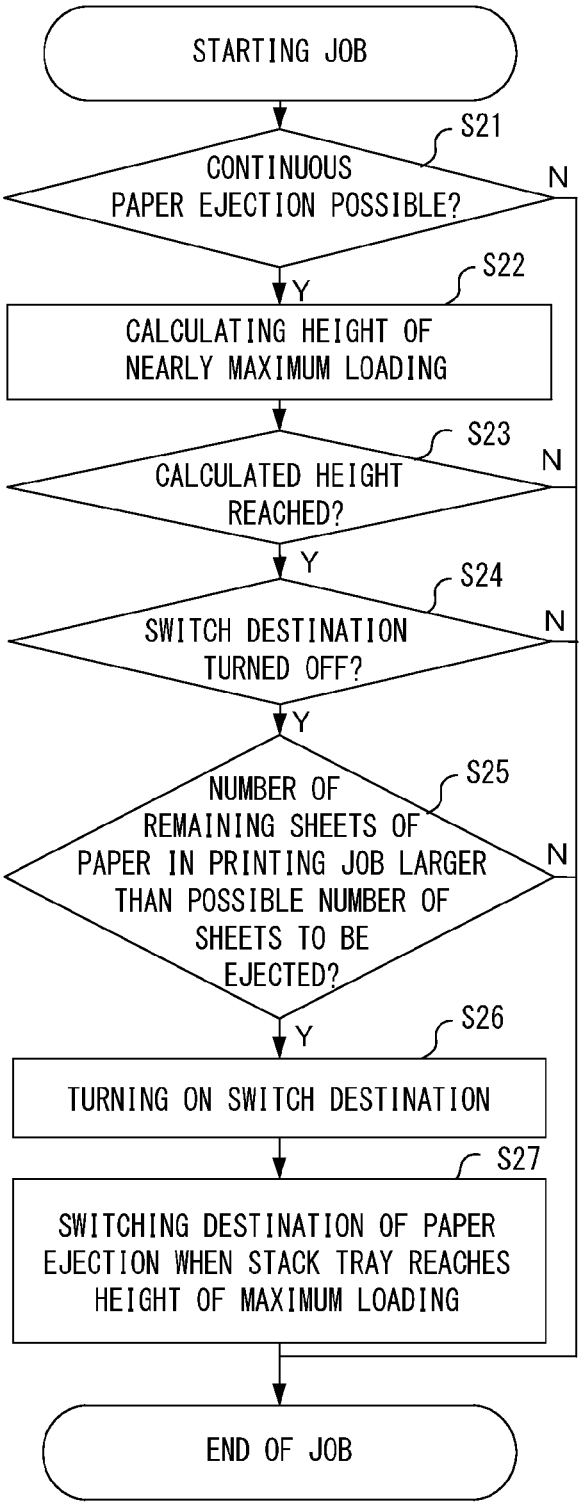
FIG. 5 is a flowchart of the processes in the second example.
Figure 7:
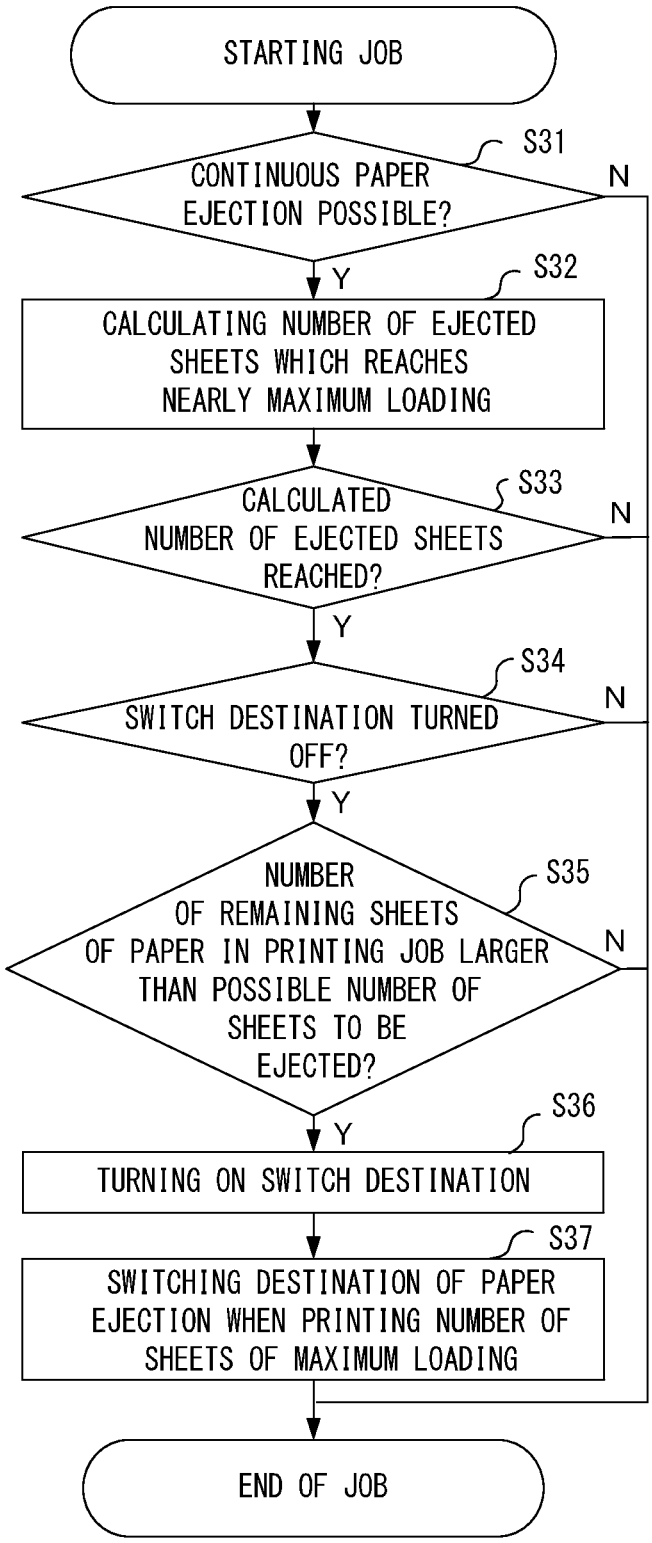
FIG. 7 is a flowchart of the processes in the third example.

Described below is three examples in which the destination of paper ejection is switched when the loading of the first paper ejection device 3 which is currently ejecting paper reaches the maximum loading. FIG. 3 is a flowchart of the first example, FIG. 5 is a flowchart of the second example, and FIG. 7 is a flowchart of the third example.

Explanation of First Example

Described first is the first example. As illustrated in FIG. 3, the printer 2 performs printing operation based on the contents of the printing job, and conveys the printed paper to the first paper ejection device 3. Then, the first paper ejection device 3 ejects the papers to the top tray 36.

The control unit 60 first judges whether or not continuous paper ejection may be performed (step S11). When the continuous paper ejection is not to be performed, the printing operation is performed without continuous paper ejection, thereby terminating the printing job. On the other hand, when the continuous paper ejection may be performed, the arithmetic unit 61 calculates the possible number of sheets to be ejected after detection by a sensor (step S12).

As described above, when the first sensor 51 detects the paper surface of the top tray 36, amount of the printing paper loaded on the top tray 36 reaches nearly maximum loading. Therefore, the possible number of sheets to be ejected is not very large.

The position where the paper surface of the top tray 36 is detected by the first sensor 51, that is, the position of the nearly maximum loading, is fixed, and the number of sheets of printing paper loaded into the top tray 36 when the paper surface is detected by the first sensor 51 is known. The value of the maximum loading of the top tray 36 is also known.

Therefore, the number of sheets that are possibly ejected may be calculated from when the first sensor 51 detects the paper surface of the top tray 36, which is when the nearly maximum loading is reached, until the maximum loading is reached. The arithmetic unit 61 performs the calculation by obtaining the possible number of sheets to be ejected after the detection by a sensor.

Next, a judgment is made as to whether or not the first sensor 51 has detected the paper surface (step S13). By the printer 2 performing printing on printing paper based on the printing job, the first paper ejection device 3 continuously ejects the paper. Thus, printed paper is stacked on the top tray 36.

The first sensor 51 detects the state in which amount of the printing paper stacked on the top tray 36 reaches the nearly maximum loading. Therefore, unless the first sensor 51 detects the paper surface, the printing job terminates before the top tray 36 loaded with the printing paper indicates the nearly maximum loading.

On the other hand, when the first sensor 51 detects the paper surface, the printing paper stacked on the top tray 36 indicates the nearly maximum loading. Then, the first sensor 51 notifies the sensor information recognition unit 62 of the detection of the paper surface.

According to the notification, the sensor information recognition unit 62 recognizes that it is time to turn on the second paper ejection device 4 which is not ejecting paper. That is, the second paper ejection device 4 is allowed to start preparing for its operation. Therefore, the sensor information recognition unit 62 controls the power supply status detection unit 63 to detect the state of the power supply of the second paper ejection device 4 (step S14).

Basically, since the second paper ejection device 4 is not ejecting paper, it is placed in the OFF position. However, the second paper ejection device 4 may be placed in the ON position. Therefore, the power supply status detection unit 63 detects whether the second paper ejection device 4 is placed in the ON or OFF position.

When the second paper ejection device 4 is placed in the ON position, it is not necessary to turn it on. On the other hand, when the second paper ejection device 4 is placed in the OFF position, the switch necessity judgment unit 64 is notified of it.

The switch necessity judgment unit 64 judges whether or not it is necessary to switch the destination of printed paper ejection from the first paper ejection device 3 to the second paper ejection device 4. Therefore, it compares the possible number of sheets to be ejected which has been calculated in step S11 with the number of remaining sheets of paper in the printing job (step S15). The number of remaining sheets of paper in the printing job indicates the number of remaining sheets of paper in the current printing job.

If the number of remaining sheets of paper in the printing job is larger than the possible number of sheets to be ejected, that is, if the nearly maximum loading is indicated but the printing job terminates before the maximum loading, then the switch necessity judgment unit 64 judges it is not necessary to switch the destination of paper ejection.

That is, the paper ejection to the first paper ejection device 3 is continued. Thus, the printing job may be terminated by ejecting paper to the first paper ejection device 3 without operating the second paper ejection device 4. As a result, it is not necessary to unnecessarily turn on the second paper ejection device 4, thereby suppressing wasteful energy consumption.

In this case, the top tray 36 is loaded with the paper of the nearly maximum loading. Therefore, the error notification is issued to remove the paper loaded on the top tray 36.

On the other hand, when the number of remaining sheets of paper in the printing job is larger than the possible number of sheets to be ejected, the switch necessity judgment unit 64 judges that all paper is not to be ejected only to the first paper ejection device 3. Therefore, the switch necessity judgment unit 64 notifies the power supply control unit 65 of it. Upon receipt of the notification, the power supply control unit 65 performs control to turn on the second paper ejection device 4 (step S16).

At this time point, although the first sensor 51 detects the nearly maximum loading, the maximum loading of the top tray 36 has not been reached. That is, the second paper ejection device 4 is turned on before amount of the paper loaded on the first paper ejection device 3 reaches the maximum loading.

Then, the notification that the power supply control unit 65 has turned on the second paper ejection device 4 is input to the paper ejection destination switch unit 66. Although the power supply control unit 65 turns on the second paper ejection device 4, a specified time is required to make the second paper ejection device 4 operable (to recover the power supply) because the second paper ejection device 4 has been placed in the OFF position.

When the power supply control unit 65 turns on the second paper ejection device 4, paper may be still ejected to the first paper ejection device 3 although it indicates the nearly maximum loading. Then, the paper ejection destination switch unit 66 switches the destination of paper ejection to the second paper ejection device 4 after number of the paper ejected to the first paper ejection device 3 after the detection by a sensor reaches the possible number of sheets to be ejected which has been calculated by the arithmetic unit 61 (step S17). Then, paper is ejected to the second paper ejection device 4 until the printing job is completed.

As described above, the control unit 60 performs control to turn on the second paper ejection device 4 before amount of the paper ejected to the first paper ejection device 3 reaches the maximum loading (nearly maximum loading). That is, before loading of the paper ejection device which is currently ejecting paper reaches the maximum loading, the paper ejection device which is not ejecting paper is controlled so that the device starts preparing its operation.

As described above, a specified power supply recovery time is required to turn on the second paper ejection device 4. Therefore, if the second paper ejection device 4 is turned on when loading of the first paper ejection device 3 reaches the maximum loading, then a waiting time arises for at least the power supply recovery time, thereby incurring lower productivity.

Therefore, control is performed to turn on the second paper ejection device 4 before amount of the paper ejected to the first paper ejection device 3 reaches the maximum loading (nearly maximum loading), thereby allowing the second paper ejection device 4 to immediately operate when amount of the paper ejected to the first paper ejection device 3 reaches the maximum loading.

Thus, there is no waiting time for the recovery of power supply, thereby improving the productivity. That is, when the power supply control unit 65 performs control so that the second paper ejection device 4 may be turned on, loading of the first paper ejection device 3 has not reached the maximum loading, and continues ejecting paper until the possible number of sheets to be ejected is counted. Therefore, the power supply recovery time of the second paper ejection device 4 may overlap the ejecting time in the first paper ejection device 3, thereby suppressing the waiting time.

In the process above, when the number of the paper ejected to the first paper ejection device 3 after the first sensor 51 detects the paper surface reaches the number of sheets of paper smaller than the possible number of sheets to be ejected which has been calculated by the arithmetic unit 61, the destination of paper ejection may be switched to the second paper ejection device 4.

For example, when the paper to be ejected is large, the ejecting time per sheet of paper is longer than the time taken by a smaller sheet of paper. Therefore, when the possible number of sheets to be ejected is calculated based on the specified size of paper, and a size of paper ejected is larger than the specified size of paper, the time taken to eject the possible number of sheets to be ejected becomes longer.

Accordingly, when the paper ejected to the first paper ejection device 3 is large, the possible number of sheets to be ejected may be reduced. In this case, although the possible number of sheets to be ejected when the paper is small is different from the number of sheets when the paper is large (smaller number of sheets than the number of sheets to be ejected), the ejecting time may be equal.

Thus, the power supply recovery time of the second paper ejection device 4 may overlap the ejecting time of the first paper ejection device 3, thereby avoiding the waiting time. Therefore, the number of ejected sheets after the detection of the paper surface by the first sensor 51 may be determined based on the power supply recovery time and the paper size.

Although it is preferable that the power supply recovery time of the second paper ejection device 4 is fully overlapped by the ejecting time of the first paper ejection device 3, a part of the power supply recovery time may be overlapped. If the power supply recovery time is overlapped by the ejecting time, the waiting time may be reduced.

Explanation of Second Example

Described next is the second example. In the second example, it is assumed that the printed paper is ejected to the stacking tray 37, not to the top tray 36. In FIG. 1, although the stapling unit 34 is provided for the first paper ejection device 3, it is assumed that no stapling process is performed in the second example for convenience of explanation.

As described above, the stacking tray 37 is provided with a drive device (not illustrated in the attached drawings) such as a motor etc., and the stacking tray 37 is lowered by driving the motor. Thus, when paper is ejected to the stacking tray 37, the height of the paper ejection may match the height of the paper surface. The motor may be continuously or intermittently driven.

Figure 4:
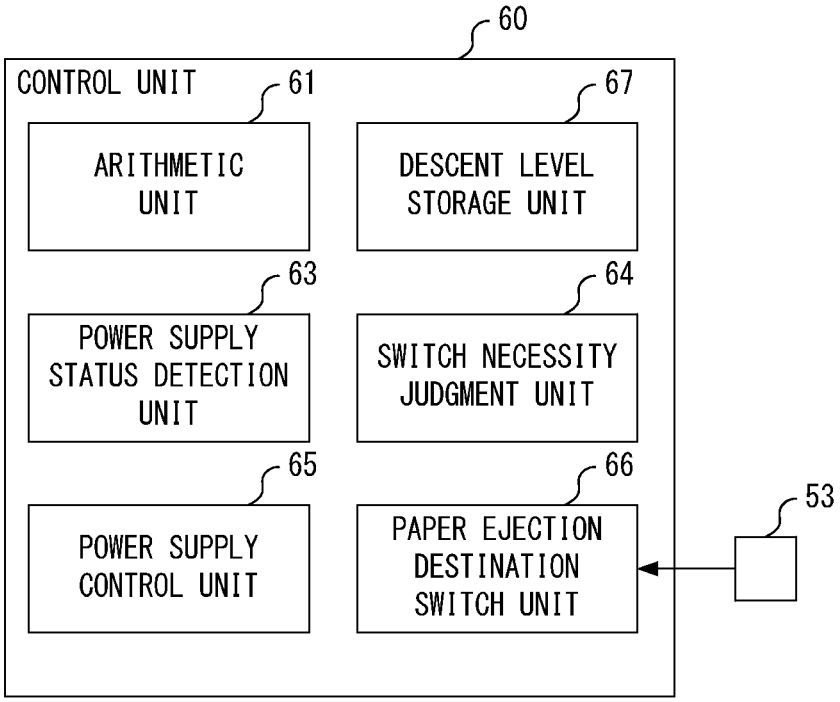
FIG. 4 is a block diagram of the function of the control unit in the second example.

FIG. 4 is the configuration of the control unit 60 in the second example. In the second example, a descent level storage unit 67 is included instead of the sensor information recognition unit 62 in the first example. The calculation of the arithmetic unit 61 is different from that in the first example.

The descent level storage unit 67 is a non-volatile storage device for storing the descent level of the stacking tray 37. That is, although the printer 2 is turned off, the descent level storage unit 67 stores the descent level of the stacking tray 37. The descent level storage unit 67 stores the descent level regardless of the number of printing jobs.

The descent level stored by the descent level storage unit 67 refers to the level lowered from the status when no printing paper is stacked on the stacking tray 37. As described above, the stacking tray 37 is lowered by the drive device such as a motor etc. Therefore, if the drive device is a motor, the descent level of the stacking tray 37 is calculated based on the rotation of the motor, and is then stored.

The operation in the second example is explained with reference to the flowchart in FIG. 5. As with the first example, when the printing job is started, the control unit 60 judges whether or not continuous paper ejection may be performed (step S21). Unless the continuous paper ejection is to be performed, a printing process is performed without continuous paper ejection, thereby terminating the printing job.

On the other hand, when it is judged that the continuous paper ejection may be performed, the arithmetic unit 61 calculates the height at the nearly maximum loading (step S22). The nearly maximum loading is similar to that explained with reference to the first example, and amount of the paper stacked on the stacking tray 37 has not reached the maximum loading, but is close to the maximum loading.

As with the first example, in the second example, control is performed so that the second paper ejection device 4 is turned on when loading of the stacking tray 37 reaches the nearly maximum loading. In the first example, the first sensor 51 detects whether or not the nearly maximum loading has been reached. In the second example, the arithmetic unit 61 calculates the height of the stacking tray 37 to judge the timing of the nearly maximum loading.

Also in the second example, the continuous paper ejection is not stopped at the timing of the nearly maximum loading of the paper stacked on the stacking tray 37, but the continuous paper ejection to the first paper ejection device 3 is performed. Then, the third sensor 53 detects the stacking tray 37 at the lowest position of the stacking tray 37. That is, when amount of the paper stacked on the stacking tray 37 reaches the maximum loading, the third sensor 53 detects it.

When loading of the stacking tray 37 reaches the nearly maximum loading, the second paper ejection device 4 is turned on, and the power supply of the second paper ejection device 4 is recovered before the tray is lowered from the position of the nearly maximum loading to the position of the maximum loading. Therefore, the position of the nearly maximum loading may be determined based on the power supply recovery time when the second paper ejection device 4 is turned on.

Furthermore, the position of the nearly maximum loading depends on also the size of the paper to be ejected. If the paper is large, the ejecting time per sheet becomes longer. Therefore, when a larger sheet of paper is ejected, the number of sheets of the paper to be ejected to the first paper ejection device 3 decreases while the power supply of the second paper ejection device 4 is recovered.

On the other hand, when the paper is small, the ejecting time per sheet becomes shorter, the number of sheets of the paper to be ejected to the first paper ejection device 3 increases while the power supply of the second paper ejection device 4 is recovered. Therefore, the height at the nearly maximum loading becomes farther from the height at the maximum loading.

Therefore, the arithmetic unit 61 may determine the height at the nearly maximum loading based on the power supply recovery time of the second paper ejection device 4 and the size of the paper to be ejected. If the size of the paper is specified in advance, the height at the nearly maximum loading may be determined based on the power supply recovery time of the second paper ejection device 4.

Next, it is judged whether or not the height of the stacking tray 37 has reached the height at the nearly maximum loading calculated by the arithmetic unit 61 (step S23). Since the descent level storage unit 67 stores the descent level of the stacking tray 37, it is judged whether or not the height of the stacking tray 37 based on the descent level stored by the descent level storage unit 67 has reached the height at the nearly maximum loading calculated by the arithmetic unit 61.

If it is judged that the height based on the descent level stored by the descent level storage unit 67 has not reached the height at the nearly maximum loading calculated by the arithmetic unit 61, paper is ejected as is to the first paper ejection device 3 until the completion of the printing job.

On the other hand, if it is judged that the height based on the descent level stored in the descent level storage unit 67 has reached the height at the nearly maximum loading calculated by the arithmetic unit 61, the power supply status detection unit 63 detects whether or not the second paper ejection device 4 to which the switching is performed has been turned on (step S24).

Next, the switch necessity judgment unit 64 judges whether or not the number of remaining sheets of paper in the printing job is larger than the possible number of sheets to be ejected (step S25). The possible number of sheets to be ejected refers to the number of sheet of paper which may be ejected in the period in which the stacking tray 37 is lowered from the height at the nearly maximum loading to the height at the maximum loading, and the possible number of sheets to be ejected is compared with the number of remaining sheets of paper in the printing job.

If number of remaining sheets of paper in the printing job is smaller than the possible number of sheets to be ejected, the paper ejection to the first paper ejection device 3 is performed, thereby terminating the printing job. On the other hand, if the number of remaining sheets of paper in the printing job is larger than the possible number of sheets to be ejected, the power supply control unit 65 performs control to turn on the second paper ejection device 4 (step S26). Thus, the power supply of the second paper ejection device 4 is recovered.

At this time point, since the stacking tray 37 is in the state of nearly maximum loading, the stacking tray 37 has not been lowered to the height at the maximum loading. Then, although the height of the stacking tray 37 has reached the height at the nearly maximum loading, the paper ejection to the first paper ejection device 3 is performed. Therefore, the stacking tray 37 becomes lowered.

When the third sensor 53 detects the stacking tray 37, amount of the printing paper stacked on the stacking tray 37 reaches the maximum loading. The third sensor 53 is connected to the paper ejection destination switch unit 66, and when the third sensor 53 detects the stacking tray 37, the notification of the detection is transmitted to the paper ejection destination switch unit 66.

When the notification is input, the paper ejection destination switch unit 66 switches the destination of paper ejection from the first paper ejection device 3 to the second paper ejection device 4 (step S27). Thus, the printed paper is ejected to the second paper ejection device 4.

As described above, also in the second example, the second paper ejection device 4 is turned on when the height of the stacking tray 37 reaches the height at the nearly maximum loading as the stage before the height of the stacking tray 37 reaches the height at the maximum loading (the height detected by the third sensor 53).

Therefore, as with the first example, the ejecting time of the first paper ejection device 3 may overlap the power supply recovery time of the second paper ejection device 4. Accordingly, when the printing paper of the first paper ejection device 3 reaches the maximum loading, the second paper ejection device 4 may be immediately operated. Therefore, the waiting time for the power supply recovery time of the second paper ejection device 4 does not arise, thereby improving the productivity.

As with the first example, also in the second example, it is preferable that the ejecting time of the first paper ejection device 3 fully overlaps the power supply recovery time of the second paper ejection device 4, but any partial overlap is acceptable.

Third Example

Described next is the third example. In the third example, as with the first example, it is assumed that the printed paper is ejected to the top tray 36. The printing paper may be ejected not to the top tray 36, but to the stacking tray 37 etc. As an optional device, an auto-fence paper ejection table (device for automatically adjusting the position of the fence based on the paper size) not illustrated in the attribute may be connected to eject printing paper on the auto-fence paper ejection table.

Figure 6:
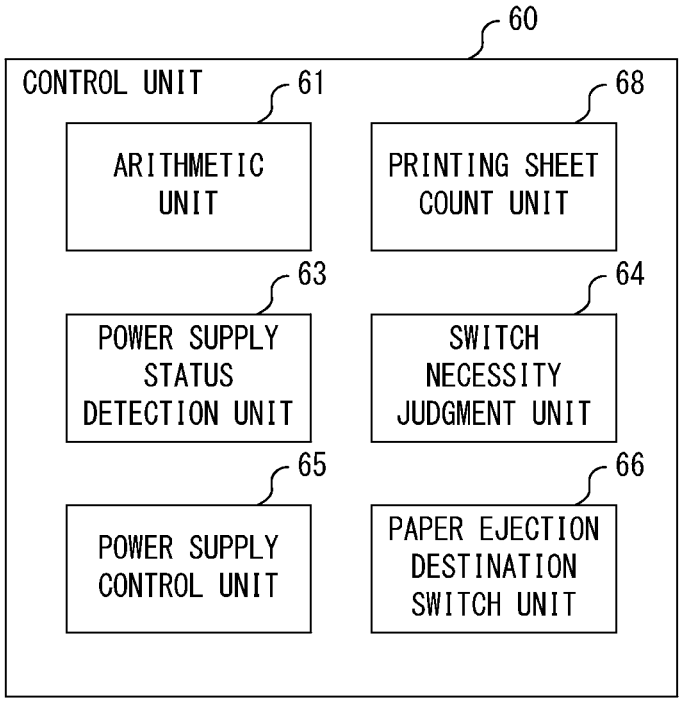
FIG. 6 is a block diagram of the function of the control unit in the third example.

FIG. 6 illustrates a control unit 60 in the third example. As illustrated in FIG. 6, a printing sheet count unit 68 is included instead of the sensor information recognition unit 62 in the first example. The contents of the calculation by the arithmetic unit 61 is also different from those in the first and second examples The printing sheet count unit 68 counts the number of printing paper ejected on the top tray 36 of the first paper ejection device 3. For example, a passage sensor not illustrated in the attached drawings is provided on the route of the printed paper in the first paper ejection device 3, and outputs a signal to the printing sheet count unit 68 each time the passage sensor detects a sheet of printing paper.

The printing sheet count unit 68 increments the number of sheets of printing paper each time the signal is received from the passage sensor. The initial value of the number of sheets of printing paper is zero. Therefore, the printing sheet count unit 68 recognizes the number of sheets of printing paper stacked on the top tray 36.

The arithmetic unit 61 calculates the number of ejected sheets indicating the nearly maximum loading based on the power supply recovery time of the second paper ejection device 4, or based on the power supply recovery time and the paper size. The number of ejected sheets at the maximum loading of the top tray 36 is known, and the number of ejected sheets at the nearly maximum loading is calculated based on the power supply recovery time, or based on the power supply recovery time and the paper size.

The operation in the third example is described with reference to the flowchart in FIG. 7. When the printing job is started, the printer 2 performs printing on printing paper. Then, a sheet of printed paper is ejected on the top tray 36. First, the control unit 60 judges whether or not continuous paper ejection may be performed (step S31). Unless the continuous paper ejection is performed, the printing is continued, thereby terminating the printing job.

Next, the arithmetic unit 61 calculates the number of ejected sheets which reaches the nearly maximum loading (step S32). As described above, the arithmetic unit 61 calculates the number of ejected sheets at the nearly maximum loading based on the power supply recovery time of the second paper ejection device 4, or based on the power supply recovery time and the paper size.

When a printing job is performed, the printer 2 executes printing, and paper ejection to the first paper ejection device 3 is performed. The printing sheet count unit 68 counts the number of sheets of paper ejected to the first paper ejection device 3. Then, it is judged whether or not the number of sheets of paper counted by the printing sheet count unit 68 has reached the number of ejected sheets at the nearly maximum loading calculated by the arithmetic unit 61 (step S33).

Unless the number of sheets of paper counted has reached the number of ejected sheets at the nearly maximum loading, the paper ejection is continued as is to the first paper ejection device 3. On the other hand, if the number of sheets of paper counted has reached the number of ejected sheets at the nearly maximum loading, then, the power supply status detection unit 63 judges whether or not the second paper ejection device 4 has been turned off (step S34). Unless the second paper ejection device 4 has been turned off, the printing job is continued as is.

On the other hand, if the second paper ejection device 4 has been turned off, the switch necessity judgment unit 64 judges the necessity to switch the destination of paper ejection. Therefore, the switch necessity judgment unit 64 judges whether or not the number of remaining sheets of paper in the printing job is larger than the possible number of sheets to be ejected (step S35). The possible number of sheets to be ejected refers to the number of sheets of paper to be ejected in the period from the number of ejected sheets at the nearly maximum loading calculated by the arithmetic unit 61 to the number of ejected sheets at the maximum loading.

If the number of remaining sheets of paper in the printing job is smaller than the possible number of sheets to be ejected, the paper ejection is continued as is, and the printing job is terminated. On the other hand, if the number of remaining sheets of paper in the printing job is larger than the possible number of sheets to be ejected, then the power supply control unit 65 turns on the second paper ejection device 4 (step S36).

When the number of sheets of paper counted by the printing sheet count unit 68 reaches the maximum loading of the top tray 36, the paper ejection destination switch unit 66 switches the destination of paper ejection from the first paper ejection device 3 to the second paper ejection device 4 (step S37). Thus, the printed paper is ejected to the second paper ejection device 4.

As described above, also in the third example, the second paper ejection device 4 which is not ejecting paper is turned on when the number of sheets of paper ejected reach the nearly maximum loading before the number of paper ejected reach the maximum loading of the top tray 36.

Therefore, as with the first and second examples, the power supply recovery time of the second paper ejection device 4 may be overlapped by the ejecting time of the first paper ejection device 3. Accordingly, when the loading of the first paper ejection device 3 reaches the maximum loading, the second paper ejection device 4 may be immediately operated. As a result, the waiting time for the power supply recovery time of the second paper ejection device 4 does not arise, thereby improving the productivity.

As with the first and second examples, also in the third example, it is preferable that the ejecting time of the first paper ejection device 3 fully overlaps the power supply recovery time of the second paper ejection device 4, but any partial overlap is acceptable.

Figure 8:
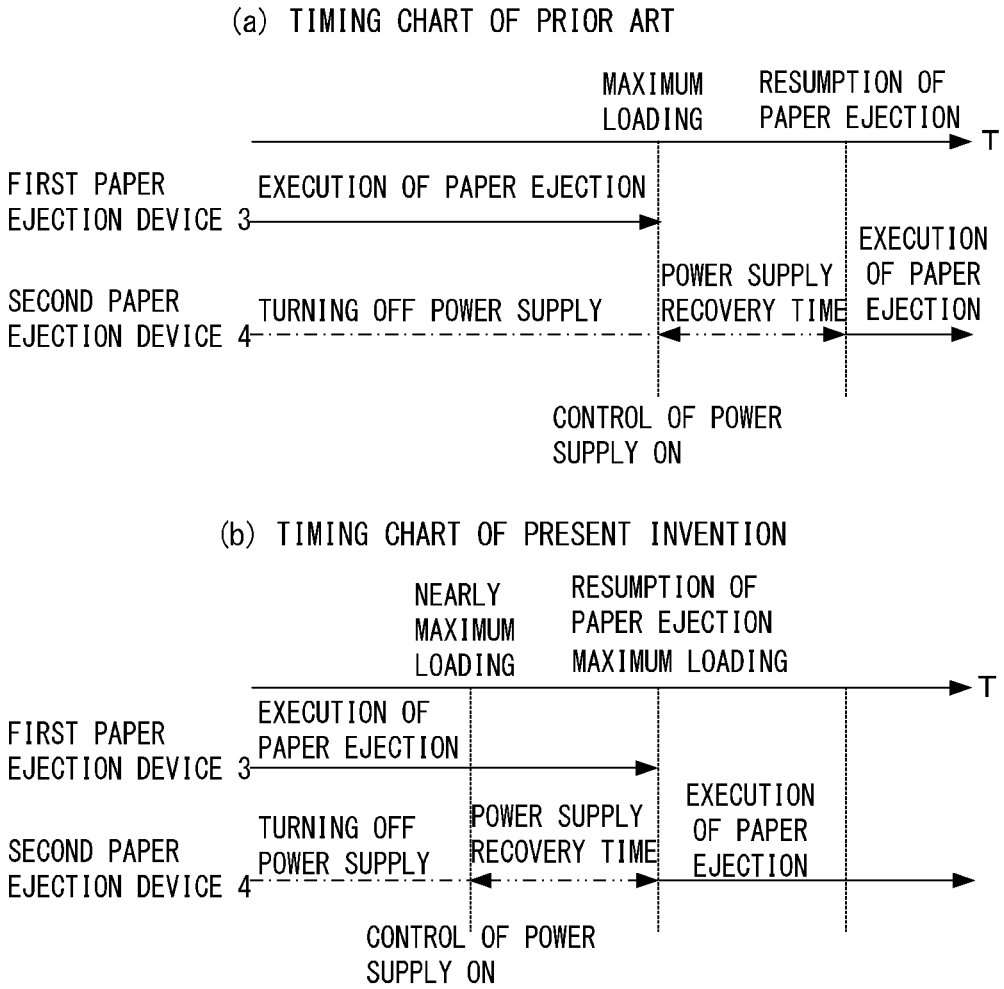
FIG. 8 is an explanatory view of a time saving effect.

Next, a time-saving effect is described with reference to FIGS. 8 and 9. First, the charts in FIG. 8 are described. Part (a) in FIG. 8 is a timing chart of a prior art, and part (b) in FIG. 8 is a timing chart of the present invention. In FIG. 8, the horizontal axis indicates time. The solid line indicates that paper ejection is executed, alternate long and short dashed lines indicate the OFF state of the power supply, and alternate long and two short dashed lines indicate the power supply recovery time.

In the timing chart of the prior art illustrated in part (a) in FIG. 8, the paper ejection to the first paper ejection device 3 is performed, and when the maximum loading is reached, the second paper ejection device 4 is turned on. Up to this time point, the second paper ejection device 4 is placed in the OFF position.

The second paper ejection device 4 recovers the power supply when amount of the paper ejected to the first paper ejection device 3 reaches the maximum loading. Therefore, after controlling the power supply, and after the passage of the power supply recovery time, the paper ejection to the second paper ejection device 4 is started. Therefore, until the resumption of the paper ejection to the second paper ejection device 4 after completing the paper ejection to the first paper ejection device 3, the waiting time arises due to the power supply recovery time. Thus, a time loss occurs, thereby degrading the productivity.

In the timing chart of the present invention illustrated in part (b) in FIG. 8, the second paper ejection device 4 is turned on at the nearly maximum loading before amount of the paper ejected to the first paper ejection device 3 reaches the maximum loading.

The paper ejection to the first paper ejection device 3 is continued until the maximum loading is reached even after the nearly maximum loading. On the other hand, control is performed to turn on the power supply of the second paper ejection device 4 at the nearly maximum loading. Therefore, the paper ejection to the first paper ejection device 3 and the recovery of the power supply of the second paper ejection device are concurrently performed. That is, the power supply recovery time of the second paper ejection device 4 may be overlapped by the ejecting time of the first paper ejection device 3.

Therefore, when amount of the paper ejected to the first paper ejection device 3 reaches the maximum loading, the second paper ejection device 4 terminates the recovery of a power supply, and may immediately operate. Therefore, the paper ejection to the second paper ejection device 4 may be resumed from the time immediately after the termination of the paper ejection to the first paper ejection device 3 without the waiting time for the recovery of a power supply.

As illustrated in the example of part (b) in FIG. 8, the waiting time may become zero by setting the timing of the first paper ejection device 3 reaching the maximum loading as the same timing of terminating the recovery of a power supply of the second paper ejection device 4 (the time point when the paper ejection is resumed). That is, when the present invention is applied, a higher time-saving effect may be obtained by the power supply recovery time than by the prior art technology. For example, when the power supply recovery time of the second paper ejection device 4 is 15 seconds, the time-saving effect of 15 seconds may be obtained.

However, as described above, if the power supply recovery time of the second paper ejection device 4 may be overlapped by the ejecting time of the first paper ejection device 3, the waiting time reducing effect may be obtained although the timing above does not completely match.

Next, the effect of power consumption is described with reference to FIG. 9. In FIG. 9, (1) indicated in the prior art and the present invention is the first paper ejection device 3, and (2) is the second paper ejection device 4.

As described above, in the prior art, since control is performed to turn on the second paper ejection device 4 when the loading of the first paper ejection device 3 reaches the maximum loading, the waiting time for the power supply recovery time arises before the paper ejection to the second paper ejection device 4 is resumed. Then, the paper ejection is resumed after the recovery of the power supply of the second paper ejection device 4.

When the paper ejection to the second paper ejection device 4 is performed until termination of the printing job, the paper ejection terminates. Thus, the second paper ejection device 4 enters an inoperable state. When the second paper ejection device 4 enters the inoperable state, the second paper ejection device 4 enters a system idle state. Then, after the passage of a specified time (system idle time), the second paper ejection device 4 is turned off.

On the other hand, in the present invention, at the nearly maximum loading, the second paper ejection device 4 is turned on. Therefore, the power supply recovery time of the second paper ejection device 4 may be overlapped by the ejecting time of the first paper ejection device 3, and when amount of the first paper ejection device 3 reaches the maximum loading, the paper ejection to the second paper ejection device 4 may be performed immediately.

Then, the second paper ejection device 4 performs the paper ejection, and enters the system idle state after the termination of the paper ejection. After the termination of the paper ejection, and after the passage of the system idle time, the second paper ejection device 4 is turned off.

Figure 9:
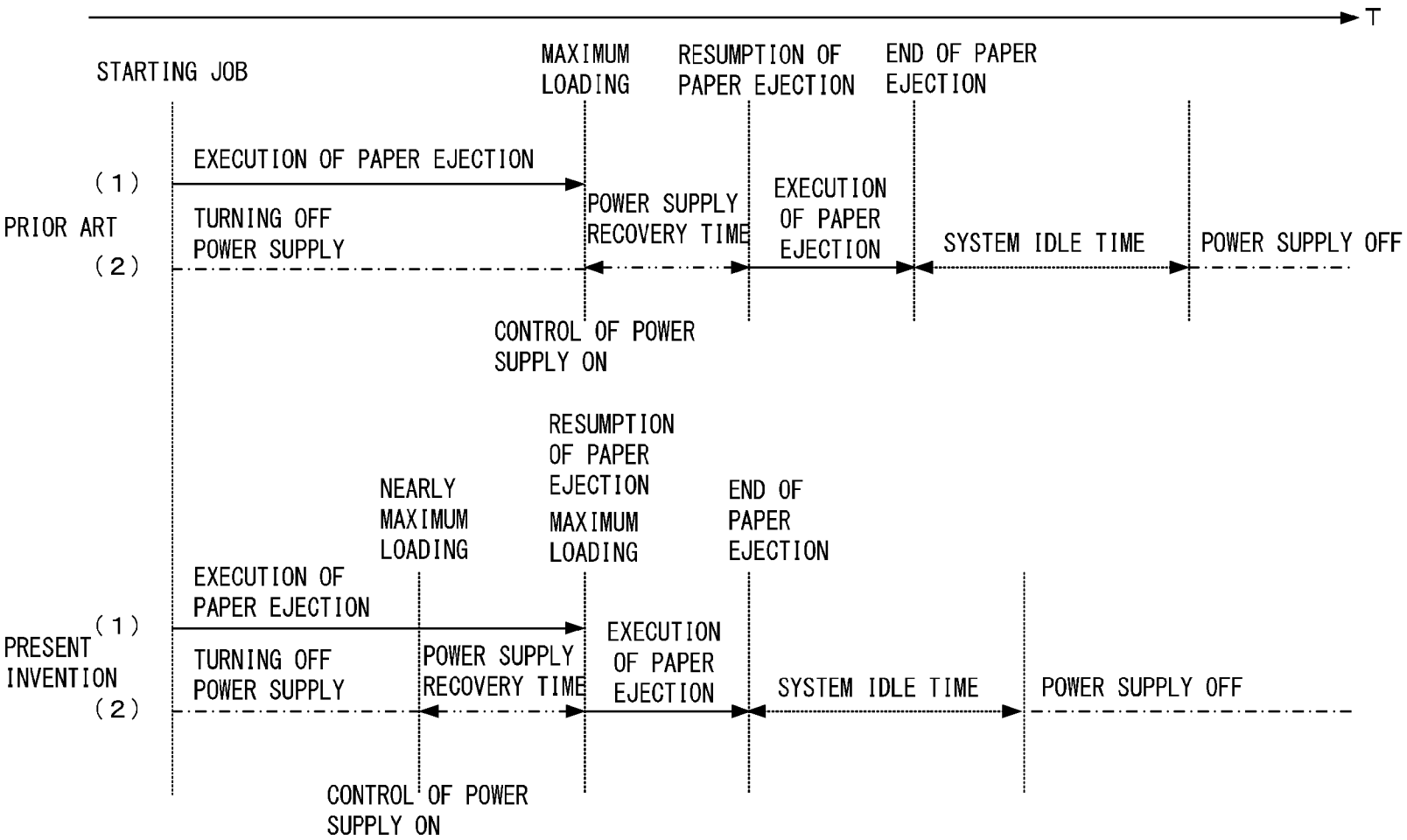
FIG. 9 is an explanatory view of the effect of reducing power consumption.

As clearly illustrated in FIG. 9, each operation of the second paper ejection device 4 is performed earlier by the power supply recovery time. That is, the timing of turning off the second paper ejection device 4 is earlier than that of the prior art by the power supply recovery time. Therefore, the time taken to turning off the second paper ejection device 4 is extended, and the present invention may reduce the power consumption as compared with the prior art.

As an example, when the power consumed by the printer 2 at the system idle time is 150 W, the power consumed by the first paper ejection device 3 is 30 W, and the power consumed by the second paper ejection device 4 is 15 W, the present invention may obtain an effect of suppressing the power consumption of 7 W/h.

Other Examples

Described above is an example of turning on the second paper ejection device 4 at the timing of the nearly maximum loading, but the timing of turning on the second paper ejection device 4 may be optional if it is before amount of the paper ejected to the first paper ejection device 3 reaches the maximum loading.

For example, the timing may not be the timing of nearly maximum loading, but may be the timing when the number of sheets of paper ejected to the first paper ejection device 3 reach a specified number of sheets of paper. Furthermore, it may be the timing after the passage of a specified time after the paper ejection to the first paper ejection device 3 is started. Furthermore, it may be the timing when a temporary stop of printing occurs after a specified number of sheets of paper ejected to the first paper ejection device 3, or after the passage of a specified time.

In addition, as described above, if the number of paper ejection devices is complicated, any number of devices may be used. For example, when paper ejection devices A, B, and C are connected to the printer 2, and when the loading of the paper ejection device A reaches the nearly maximum loading, the paper ejection device B is turned on. Then, when amount of the paper ejected to the paper ejection device A reaches the maximum loading, paper ejection to the paper ejection device B is performed.

Next, when amount of the paper ejected to the paper ejection device B reaches the nearly maximum loading, the paper ejection device C is turned on. When amount of the paper ejected to the paper ejection device B reaches the maximum loading, the paper ejection to the paper ejection device C is started.

Therefore, when three or more paper ejection devices are required in the case of a large volume printing operation or the like, the destination of paper ejection is sequentially switched, thereby performing the continuous paper ejection without waiting time for the power supply recovery time of each paper ejection device. Therefore, the productivity may be improved.

Configuration of Image Forming Apparatus in the Second Embodiment

Figure 10:
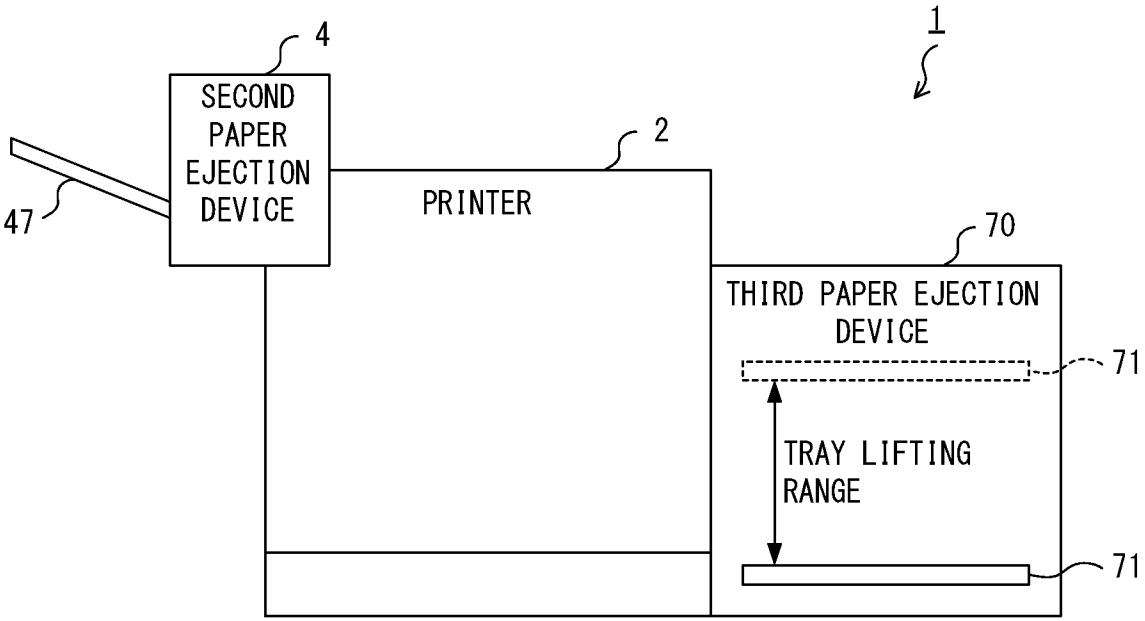
FIG. 10 is a rough configuration of an image forming apparatus according to the second embodiment.

Described next is the second embodiment. FIG. 10 illustrates a simplified configuration of the image forming apparatus 1 according to the second embodiment. In the first embodiment, the first paper ejection device 3 is connected to the printer 2, but a third paper ejection device 70 is connected to the printer 2 instead of the first paper ejection device 3 in the second embodiment. The third paper ejection device 70 is also an optional device to be connected to the printer 2.

The third paper ejection device 70 is a paper ejection device capable of performing a large volume printing, and includes a platform 71. The platform 71 is moved up and down by a motor etc. The position indicated by the broken line in FIG. 10 is the most lifted position (highest position). The highest position is also referred to as a home position. The position indicated by the solid line is the most dropped position (lowest position). At the highest position of the platform 71, that is, at the height of the home position, a paper ejection port for ejection of paper is provided.

The paper ejected from the printer 2 is stacked on the platform 71. When the platform 71 is placed at the highest position, no paper is stacked on the platform 71. When paper is ejected, the platform 71 is continuously or intermittently lowered by the driving force of a motor etc. when amount of the paper stacked on the platform 71 reaches the maximum loading, the platform 71 is placed at the lowest position.

Although paper is removed from the platform 71, the platform 71 is not lifted unless the motor etc. is operated, but stops as is. For example, although the paper is removed from the platform 71 when amount of the paper stacked on the platform 71 reaches the maximum loading, the platform 71 which is not loaded with paper stays at the lowest position so far as the platform 71 is not lifted.

Figure 11:
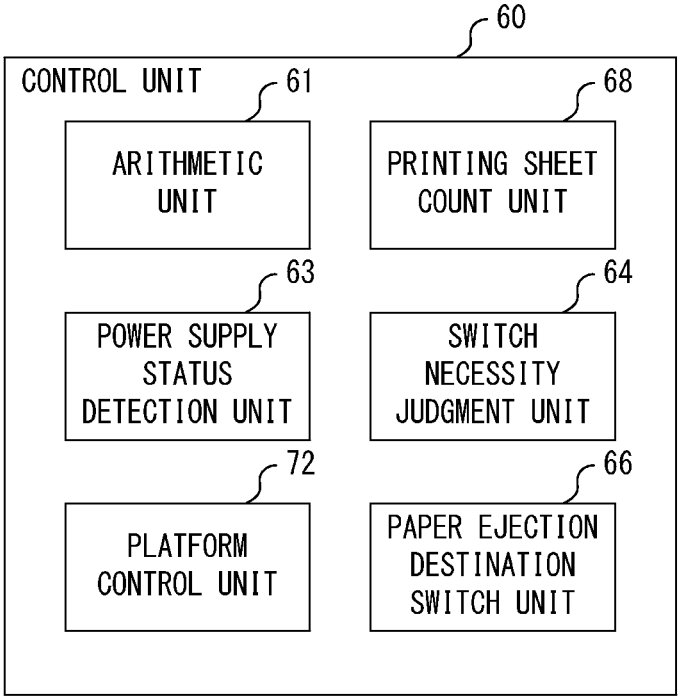
FIG. 11 is a block diagram of the function of the control unit according to the second embodiment.

FIG. 11 illustrates the control unit 60 in the second embodiment. The control unit 60 corresponds to the third example according to the first embodiment. The difference from the third example is that a platform control unit 72 is provided instead of the power supply control unit 65 illustrated in FIG. 6 in the third example.

The platform control unit 72 performs control to lift the platform 71. The third paper ejection device 70 is provided with a device (not illustrated in the attached drawings) for detecting the position of the platform 71, and when the platform 71 is at the highest position, the platform 71 is not lifted.

Figure 12:
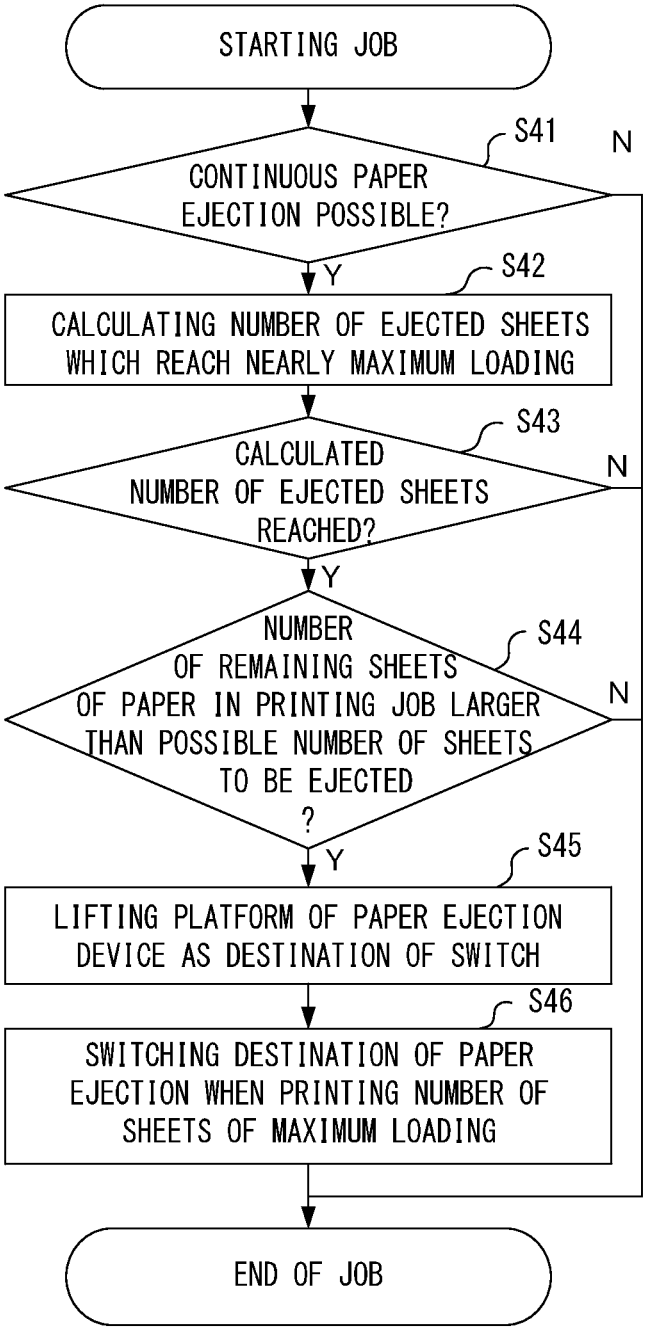
FIG. 12 is a flowchart of the processes according to the second embodiment.

FIG. 12 is a flowchart according to the second embodiment. First, a printing job is started, and the printer 2 performs a printing operation. In this example, it is assumed that the paper printed by the printer 2 is continuously ejected to the second paper ejection device 4 illustrated in FIG. 10. The control unit 60 judges whether or not the continuous paper ejection may be performed (step S41). If the continuous paper ejection is not to be performed, the printing operation is continued, and then the printing job is terminated.

The arithmetic unit 61 calculates the number of ejected sheets which reaches the nearly maximum loading (step S42). The nearly maximum loading in this case is obtained based on the time required to lift the platform 71 up to the highest position.

When the third paper ejection device 70 is provided with a device for detecting the position of the platform 71, the number of ejected sheets at the nearly maximum loading is calculated depending on the position of the platform 71 detected based on the time required to lift the platform up to the highest position.

Then, the printing sheet count unit 68 counts the number of sheets of printed paper. Then, it is judged whether or not the number of sheets of printed paper has reached the number of ejected sheets calculated by the arithmetic unit 61 (step S43).

Unless the number has not been reached, the printing operation is continued as is, thereby terminating the printing job. On the other hand, if the number of sheets of printed paper counted reaches the number of ejected sheets calculated by the arithmetic unit 61, the switch necessity judgment unit 64 judges whether or not the number of remaining sheets of paper in the printing job is larger than the possible number of sheets to be ejected (step S44).

If the number of remaining sheets of paper in the printing job is smaller than the possible number of sheets to be ejected, then the remaining printing job is performed without switching the destination of paper ejection, thereby terminating the printing job. On the other hand, if the number of remaining sheets of paper in the printing job is larger than the possible number of sheets to be ejected, then the switch necessity judgment unit 64 judges that the destination of paper ejection is to be switched into the third paper ejection device 70.

In this case, the platform 71 of the third paper ejection device 70 as the destination of switching is lifted up to the highest position (step S45). When the platform 71 is originally placed in the highest position, the platform 71 is not lifted. When the power supply status detection unit 63 detects that the third paper ejection device 70 is placed in the OFF position, the third paper ejection device 70 is turned on.

When amount of the paper ejected to the second paper ejection device 4 reaches the maximum loading, the paper ejection device is switched to the third paper ejection device 70 (step S46). Therefore, at the nearly maximum loading, the platform 71 is lifted up to the highest position, and the paper ejection to the third paper ejection device 70 may be immediately performed when the paper ejection device is switched to the third paper ejection device 70.

If the platform 71 is lifted up to the highest position when amount of the paper ejected to the second paper ejection device 4 reaches the maximum loading, there occurs a waiting time for the lifting time, thereby incurring degraded productivity.

In the second embodiment, the platform 71 is lifted at the timing when amount of the paper ejected to the second paper ejection device 4 reaches the nearly maximum loading before the maximum loading, and no waiting time (for lifting time) occurs. That is, since the lifting time of the platform 71 is overlapped by the ejecting time in which the paper ejection to the second paper ejection device 4 is performed, the paper ejection device may be switched to the third paper ejection device 70 immediately after the termination of the paper ejection to the second paper ejection device 4.

In the second embodiment, if the third paper ejection device 70 is placed in the OFF position when the platform 71 is lifted, the device is turned on, and then the platform 71 is lifted or lowered. In the first embodiment, control is performed to turn on the second paper ejection device 4 when the second paper ejection device 4 is placed in the OFF position. However, in the second embodiment, the operation may be applied also when the second paper ejection device 4 is turned on. That is, when the second paper ejection device 4 is turned on at the nearly maximum loading the platform 71 is lifted.

In the first embodiment, the waiting time is suppressed by overlapping the power supply recovery time of the paper ejection device which is not currently ejecting paper with the ejecting time of the paper ejection device which is ejecting paper. In the second embodiment, the waiting time is suppressed by overlapping the lifting time of the platform of the paper ejection device which is not currently ejecting paper with the ejecting time of the paper ejection device which is ejecting paper.

The recovery of a power supply and the lifting of a platform are the operation of preparing for the operation of the paper ejection device which is not ejecting paper. Therefore, the waiting time may be suppressed by overlapping the preparation time for the operation of the paper ejection device which is not ejecting paper with the ejecting time of the paper ejection device which is ejecting paper, thereby improving the productivity.

In the second embodiment, the platform 71 is lifted to the highest position because the ejecting position (ejection port) of the third paper ejection device 70 is placed at the highest position. In this respect, if the ejection position of the third paper ejection device 70 is not the highest position of the platform 71, the platform 71 may be lifted to the ejection position lower than the highest lifting position of the platform 71. That is, the position at which the platform 71 is lifted is not limited to the highest position, but may be the ejection position (ejection port) of the third paper ejection device 70.

As described above, control is performed to switch the destination of paper ejection based on the time required to operate the paper ejection device which is not ejecting paper and the number of ejected sheets up to the maximum loading of the paper ejection device which is performing continuous paper ejection. Therefore, the time required to operate the paper ejection device which is not ejecting paper may be overlapped by the ejecting time of the paper ejection device which is performing continuous paper ejection. Thus, the destination of paper ejection may be quickly switched, thereby improving the productivity.

Furthermore, since the power supply recovery time may be overlapped by the ejecting time of the paper ejection device which is continuously ejecting paper, the destination of paper ejection may be quickly switched. In addition, since the timing of turning off the paper ejection device is earlier by overlapping the power supply recovery time, an effect of suppressing consumed energy may be obtained.

Furthermore, since a calculation unit calculates the timing by considering the paper size, the waiting time may be suppressed although the ejecting time and the floating time are different when paper is ejected by changing the paper size.

In addition, since the time taken for a platform of paper ejection device which is not ejecting paper to reach the ejection position may be overlapped by the ejecting time of the paper ejection device which is continuously ejecting paper, the destination of paper ejection may be quickly switched.

The embodiments and merits of the disclosed invention is described above in detail, but those skilled in the art may attain various changes, additions, and omission without deviation from the scope of the present invention described in the claims of the invention.

What is claimed is:

1. An image forming apparatus having a plurality of paper ejection devices, the image forming apparatus comprising:

a control unit which performs control to allow, before a first paper ejection device which is continuously ejecting paper from among the plurality of paper ejection devices ejects paper over a maximum loading, a second paper ejection device which is not ejecting paper to prepare for starting an operation, the control being performed based on (i) a time taken for the second paper ejection device which is not ejecting paper to become operable and (ii) a number of ejectable sheets before a loading of the first paper ejection device which is continuously ejecting paper reaches the maximum loading.

2. The apparatus according to claim 1, wherein:

the control unit comprises:

a power supply state detection unit which detects whether or not the second paper ejection device which is not ejecting paper has been turned off;

a power supply control unit which turns on the second paper ejection device which has been turned off at a timing to prepare for starting the operation; and a paper ejection destination switch unit which switches a destination of paper ejection to the second paper ejection device which is not ejecting paper when the second paper ejection device which is not ejecting paper is turned on and the loading of the first paper ejection device which is continuously ejecting paper reaches the maximum loading.

3. The apparatus according to claim 2, wherein:

the control unit further comprises:

an arithmetic unit which calculates the timing based on the time and a paper size of printing paper with which the continuous paper ejection is being performed when a specified loading not more than the maximum loading is detected in the first paper ejection device which is continuously ejecting paper.

4. The apparatus according to claim 1, wherein:

the control unit comprises:

an arithmetic unit which calculates a timing based on the time and a paper size of printing paper with which the continuous paper ejection is being performed when a specified loading not more than the maximum loading is detected in the first paper ejection device which is continuously ejecting paper.

5. The apparatus according to claim 1, wherein:

the second paper ejection device which is not ejecting paper is a paper ejection device configured such that paper may be ejected by lifting and lowering a platform, and the control unit comprises:

an arithmetic unit which calculates a timing at which the second paper ejection device which is not ejecting paper is allowed to prepare for starting the operation based on a time until the second paper ejection device which is not ejecting paper may be operated;

a platform control unit which performs control to lift the platform of the second paper ejection device which is not ejecting paper at the timing calculated by the arithmetic unit; and a paper ejection destination switch unit which switches a destination of paper ejection to the second paper ejection device which is not ejecting paper when the platform reaches a paper ejection position.

* * * * *